United States Patent [19]

Lofton et al.

[11] Patent Number: 5,040,470

[45] Date of Patent: Aug. 20, 1991

[54] STEAM GENERATING SYSTEM WITH $NO_x$ REDUCTION

[75] Inventors: Ruth E. Lofton; Dale E. Robinson; Daniel H. Hutchinson, all of Bakersfield, Calif.

[73] Assignee: Shell Western E&P Inc., Houston, Tex.

[21] Appl. No.: 614,360

[22] Filed: Nov. 15, 1990

Related U.S. Application Data

[62] Division of Ser. No. 173,323, Mar. 25, 1988, Pat. No. 5,002,484.

[51] Int. Cl.[5] ..... F23B 7/00

[52] U.S. Cl. ..... 110/234; 110/188; 110/204; 432/72; 432/222; 122/135.1

[58] Field of Search ..... 432/222, 72, 180; 110/188, 204, 234; 122/135.1

[56] References Cited

U.S. PATENT DOCUMENTS

| | | | |
|---|---|---|---|
| 3,472,498 | 10/1969 | Price et al. | 432/72 |
| 3,861,334 | 1/1975 | Stockman | 110/204 |
| 3,947,235 | 3/1976 | Bornert | 432/72 |
| 4,004,875 | 1/1977 | Zink et al. | 431/9 |
| 4,162,140 | 7/1979 | Reed | 239/431 |
| 4,182,246 | 1/1980 | Lombana et al. | 110/188 |
| 4,253,404 | 3/1981 | Leonard | 110/188 |
| 4,255,132 | 3/1981 | Carthew | 432/72 |
| 4,297,093 | 10/1981 | Morimoto et al. | 431/10 |
| 4,324,545 | 4/1982 | Hubbert | 432/222 |
| 4,331,086 | 5/1982 | Fitch et al. | 110/204 |
| 4,358,268 | 11/1982 | Neville | 432/180 |
| 4,505,665 | 3/1985 | Mansour | 431/10 |
| 4,568,279 | 2/1986 | Logue et al. | 432/72 |
| 4,618,323 | 10/1986 | Mansour | 431/177 |
| 4,715,810 | 12/1987 | Ramsey et al. | 432/72 |
| 4,975,047 | 12/1990 | Mitsuhashi et al. | 432/72 |

OTHER PUBLICATIONS

Energy Technology Handbook, Douglas M. Considine, McGraw-Hill, 6/1977, pp. 9-335 to 9-348, "NOx Control by Furnace and Burner Design".

"Testing of Low-NOx Combustion Retrofit", L. L. Larsen and W. A. Carter, KVB Report (KVB 71 60412-2067).

Transjet ® Burner, Hague International (promotional literature).

"Introduction to COEN Low NOx Burner", COEN Company, Inc. (promotional literature).

"COEN Low NOx Design Techniques Readily Solve Your Emission Problems", (Technical Bulletin 20-102, COEN Co., Inc. (promotional literature).

"High-Performance, Lo-NOx ® Energy-Miser Burners" (Bulletin 52LN), National AirOil Burner Company, Inc.

"NOx Control for Gas-Fired Steam Generators", Energy and Environmental Research Corporation (promotional literature).

*Primary Examiner*—Henry C. Yuen

*Attorney, Agent, or Firm*—Mark A. Smith

[57] ABSTRACT

A method and system for flue gas recirculation is disclosed which will minimize NOx production from hydrocarbon combustion. In the present invention a furnace having an oxygen-bearing primary source of combustion air, a mixing chamber, a combustion chamber in downstream communication with the mixing chamber and an exhaust section downstream of the combustion chamber is provided with a flue gas recirculation line. The recirculation line establishes communication between the exhaust section and the mixing chamber for the return of combustion products as a secondary source of combustion air which is relatively lean in oxygen and is combined with the primary source of combustion air in the mixing chamber. The ratio of flow rates for the primary and secondary sources of combustion air is controlled by a signal generated by a sensor which senses the oxygen concentration in the mixing chamber.

4 Claims, 4 Drawing Sheets

STEAM GENERATING SYSTEM WITH $NO_x$ REDUCTION

This is a division of application Ser. No. 173,323, filed Mar. 25, 1988 now U.S. Pat. No. 5,002,484.

BACKGROUND OF THE INVENTION

The present invention relates to a system and method for reducing pollutants from the combustion of hydrocarbon fuel and, more particularly, to a system and method for recirculating flue gas in a controlled, optimimized manner to minimize NOx formation as a product of hydrocarbon combustion.

NOx is a common designation representing two oxides of nitrogen, nitric oxide (NO) and nitrogen dioxide ($NO_2$). Together, these compounds react with hydrocarbons in the presence of oxygen and sunlight to form photochemical smog. It is for this reason that environmental concerns and attendant regulatory controls have required efforts to limit the amount of NOx generated by the combustion of hydrocarbon fuels.

Hydrocarbon-fired steam generators used for enhanced oil recovery are illustrative of this need and provide the preferred embodiment discussed hereinafter. In such applications, multiple furnace units and attendant steam generators are widely separated over an oil-bearing formation and must use available hydrocarbon fuel to convert water to steam for steam-flooding the underground formation. The feedstock fuel available is most often unprocessed or minimally processed natural gas or crude oil. Many different compounds may be present and mixed in such fuel, but a typical natural gas mixture might include:

| Component | Volume % |
|---|---|
| $CH_4$ | 92% |
| $C_2H_6$ | 3% |
| $C_3H_8$ | 1% |
| $C_4H_{10}$ | 1% |
| Other Hydrocarbons | 3% |

Typical combustion in a furnace unit for an enhanced oil recovery steam generator would yield combustion products as follows:

$$C_AH_B+O_2+N_2 \rightarrow CO_2+H_2O+N_2+NOx+CO$$

More specifically to point, the particular mechanism, thermal NOx production, responsible for oxidizing nitrogen in the ambient combustion air can be summarized as follows:

$$O_2 \rightleftarrows 2\,O \text{ initiation, presence of heat}$$

$$N_2 + O \rightleftarrows NO + O \text{ propagation } T > 2{,}800^\circ \text{ F.}$$

$$O_2 + N \rightleftarrows NO + O \text{ propagation } T > 1{,}500^\circ \text{ F.}$$

The elevated temperature within the furnace supplies the energy for oxygen molecules to dissociate and, as the temperature rises into the range of 2,800° to 3,000° F., the oxygen free radicals have sufficient energy to split bonds within the nitrogen molecules supplied by the combustion air. One of these nitrogen atoms combines with the oxygen and the other is sufficiently reactive to break another oxygen-oxygen bond, thereby forming another NOx molecule and producing another oxygen free radical to further propagate NOx production.

Without pollution controls, such combustion might yield NOx in the range of 0.06 to 0.1 pounds per million Btu fired.

However, it is known that recycling a portion of the combustion products in the exhaust or flue gas dilutes the oxygen concentration presented in the combustion air available for the combustion reaction and can significantly reduce NOx production. A key mechanism in reducing the NOx concentration is the effect that this dilution has on the temperature of the flame within the furnace. Significantly increasing the amount of inert gas in the combustion air increases the amount of gas which must be heated, but does so without correspondingly increasing the amount of oxygen available for combustion. Thus, the heat load drawing on the combustion reaction is higher and the recycled flue gas serves to lower the temperature of the flame within the furnace. This in turn reduces the formation of NOx as a combustion product because the reactions necessary for NOx formation are not favored by the lower reaction temperatures.

However, as discussed above, the NOx reduction is a sensitive function of the temperature of the combustion reaction and is materially influenced within a relatively narrow range. Thermal NOx production increases nearly exponentially once the combustion temperature exceeds a critical temperature in the range of 2,800° to 3,000° F. and unmodified combustion materially exceeds this critical temperature while ideal flue gas recirculation produces combustion temperature slightly below this. Thus, too much oxygen and the reaction temperature, and thereby the NOx concentration within the combustion products, substantially increases. Conversely, insufficient oxygen produces incomplete combustion which increases the concentration of carbon monoxide and other undesirable pollutants and potentially destabilizes the combustion reaction.

The prior art teaches control of the flue gas recirculation on a volumetric basis, either directly metering the flow rate of the flue gas returned or by performing a material balance utilizing the temperature of the flue gas, ambient air, and blended combustion air along with a known capacity for the blower drawing the ambient air into the furnace unit. A damper or other manual or automatic control means in the recirculation lines is then set based upon the calculated volume of recirculated flue gas. This may be enhanced by directly metering the volume of flue gas returning through the recirculation line to correspond to the calculated flow rate.

However, the prior art methods of reducing NOx produced are an indirect approximation and are not responsive to the realities of dynamic operation. Variations in the ambient temperature, furnace temperature, fuel composition, load on the furnace, etc. all render the use of such approximation techniques a crude tool to estimate the appropriate rate of flue gas recirculation. Further, it is necessary that the setting be substantially conservatively oxygen-rich in order to accommodate variations and inaccuracies in estimates because running the furnace too oxygen-lean risks unsafe and unstable combustion. Thus, the conservative safety margins necessary to account for the variations discussed above must be accommodated in a system and process that are very sensitive to even small variations. This results in less than optimal performance and materially increases the level of NOx produced during combustion.

The prior art has also approached reducing the NOx concentration in combustion products by manually or automatically controlling the capacity of the blower as a function of the concentration of unconsumed oxygen appearing in the flue gas. While this does serve to decrease the absolute amount of oxygen presented in the combustion air, it does nothing to alter the thermal load by increasing the ratio of inert materials to oxygen in the combustion air presented. Again, the commercially achievable results have been limited.

SUMMARY OF THE INVENTION

It is therefore an object of the present invention to provide a system for combustion of hydrocarbon fuel which monitors the amount of oxygen in the combustion air for the purpose of maximizing the recirculation of low oxygen flue gas into the combustion air, thereby lowering the temperature of the combustion reaction and minimizing NOx production.

Another object of the present invention is to establish a controlled flue gas recirculation which insures sufficient oxygen in the combustion air to support stable combustion yet leans the oxygen concentration in order to reduce NOx production.

Finally, it is an object of the present invention to improve steam generators for enhanced oil recovery in which flue gas recirculation is controlled to minimize NOx production yet ensure sufficient oxygen for stable, efficient, and complete combustion of hydrocarbon fuel within the furnace unit supplying the thermal energy for converting water into steam for injection into a hydrocarbon reservoir.

Toward the fulfillment of these and other objects for establishing a combustion system for hydrocarbon fuel, the present invention comprises a furnace having an oxygen-bearing primary source of combustion air, a mixing chamber, a combustion chamber in downstream communication with the mixing chamber and an exhaust section downstream of the combustion chamber. A recirculation line establishes communication between the exhaust section and the mixing chamber for the return of combustion products as a secondary source of combustion air which is relatively lean in oxygen and is combined with the primary source of combustion air in the mixing chamber. The ratio of flow rates for the primary and secondary sources of combustion air is controlled by a signal generated by a sensor which senses the oxygen concentration in the mixing chamber.

A BRIEF DESCRIPTION OF THE DRAWINGS

The above brief description as well as further objects, features and advantages of the present invention will be more fully appreciated by reference to the following detailed description of the presently-preferred, but nonetheless illustrative, embodiment of the present invention with reference to the accompanying drawings in which.

A DETAILED DESCRIPTION OF THE PREFERRED EMBODIMENT

Figure 1:
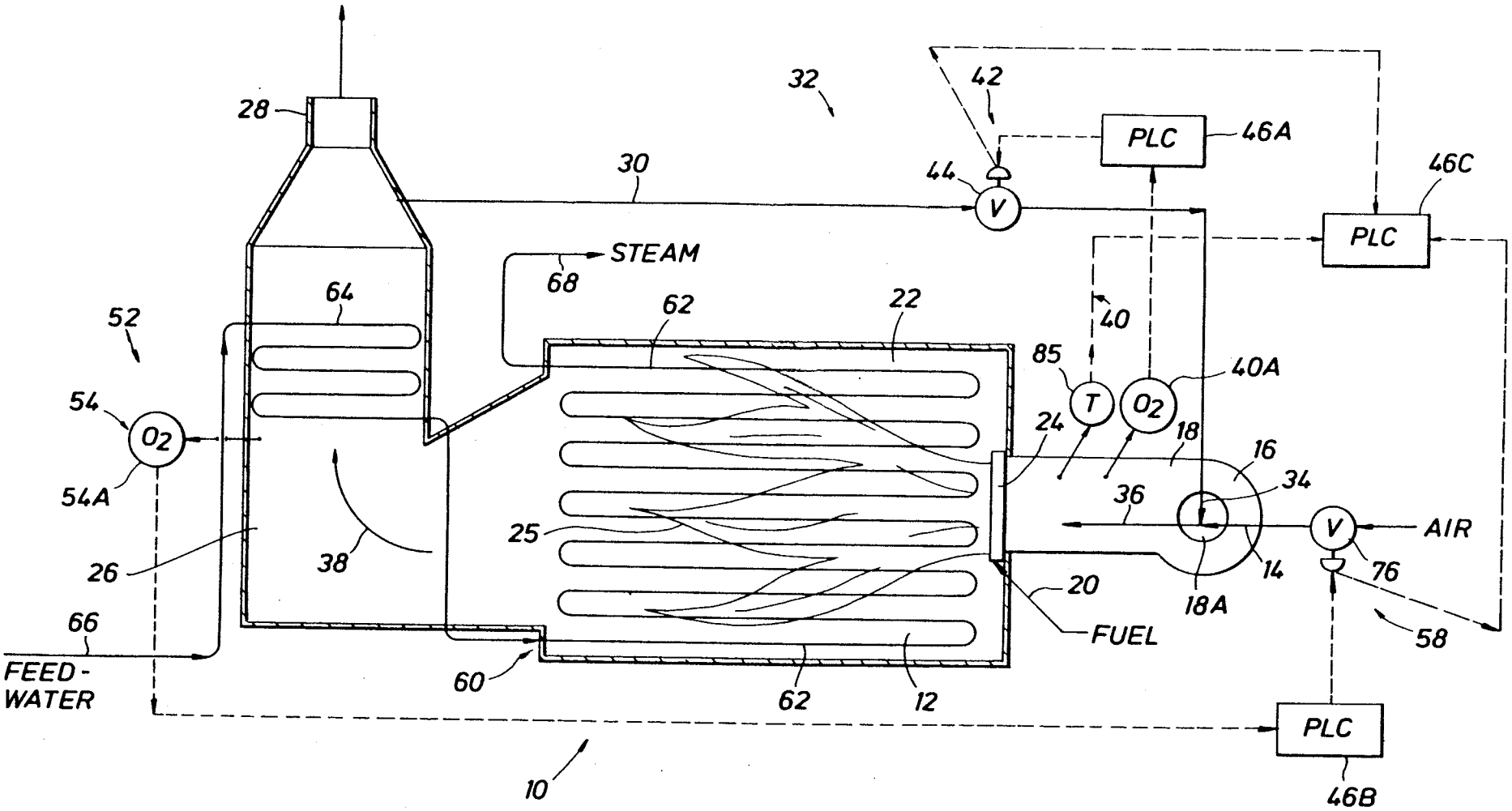
FIG. 1 is a schematic illustration of a steam generator incorporating the present invention.

FIG. 1 illustrates a steam generator 10 for use in enhanced oil recovery which employs a hydrocarbon-driven furnace 12 to convert water to steam. Furnace 12 is provided with a primary source of combustion air 14 in communication with a blower 16 which feeds into a mixing chamber 18.

A combustion chamber 22 of furnace 12 is provided in downstream communication with mixing chamber 18. Combustion chamber 22 will also include fuel inlet 20 and an ignition device 24. An exhaust section 26 is downstream of the combustion chamber and leads to a flue or stack 28.

A combustion system in accordance with the present invention includes a flue gas recirculation system 32 which, in the preferred embodiment, includes recirculation line 30 which provides communication between exhaust section 26 and mixing section 18 of furnace 12. Further, flue gas recirculation system 32 is provided with a means 40 for sensing the oxygen concentration in the mixing chamber and generating a signal as a function thereof. In the preferred embodiment oxygen is sensed directly with an in-situ sampling type sensor, sensor 40A. Alternatively, a probe type sensor can provide directly, or indirectly, a measure of the oxygen concentration in the combined combustion air and other sensors will be apparent to those skilled in the art upon consideration of the teachings presented herein. A means 42 is provided for controlling the flow ratio of the primary and secondary sources of combustion air which is provided to mixing chamber 18 as a function of the signal from sensor 40A. In the preferred embodiment, means 42 for controlling the flow ratio is provided by a means for controlling the rate of flow for the recirculating flue gas and includes a valve 44 actuated by a programmable logic controller 46A which respond substantially independently of the flow rate of the primary source of combustion air which is substantially stabilized at this stage of operation. Other means for controlling the ratio between the primary and secondary sources of combustion air will be apparent to those having ordinary skill in the art, including substantially stabilizing the primary source and otherwise adjusting a blower or other drive of the secondary source, providing both sources of combustion air with separate blowers or other drives and adjusting the relative speeds of the drives, adjusting relative postions of valves, etc.

Flue gas recirculation system 32 thereby delivers a second source of combustion air 34 through recirculation line 30 to mixing chamber 18. The secondary source of combustion air 34 is characterized by a much lower oxygen concentration and this oxygen-lean mixture of inert combustion products is combined with the relatively oxygen-rich primary source of combustion air 14 to produce blended or combined combustion air 36. In the preferred embodiment, primary and secondary combustion air both enter the suction line 18A of blower 16 which, together with the throat of the furnace which leads to the combustion chamber, make up the mixing chamber. However, a separate blower may be provided to the recirculating flue gas or other modifications may be made to mixing chamber 18 which will be apparent to those skilled in the art to provide a blending of the primary and secondary sources of combustion air.

In the preferred embodiment, furnace 12 is provided with a second control system 52 which includes a second means 54 for sensing the oxygen concentration in the combustion products of flue gas 38. Second means 54 for sensing oxygen concentration, here sensor 54A, generates an output signal which is a function of the oxygen concentration in the flue gas and delivers this signal to a means 58 for controlling the flow of the primary source of combustion air 14. A programmable logic controller 46B provides the preferred control for valve 76 of control means 58.

Steam generator 10 is provided with a heat exchanger 60 which, in the preferred embodiment, includes a radiant section 62 and a convection section 64 through which water is heated as it passes from a source 66 to an outlet 68. The water is preheated in convection section 64 then converted to steam in radiant section 62 which exits outlet 68 and is driven into a hydrocarbon bearing formation through an injection well.

Figure 2:
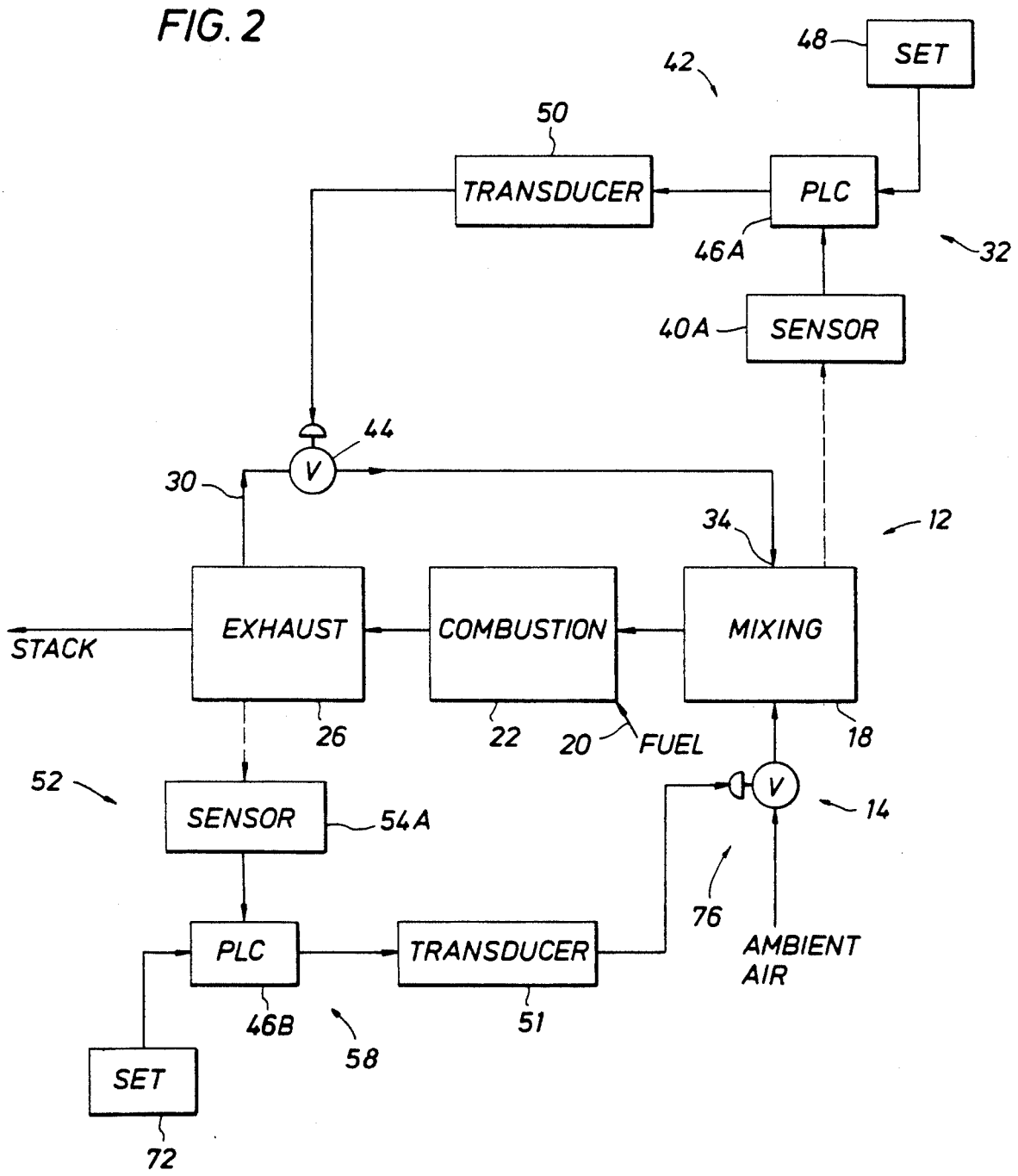
FIG. 2 is a block diagram of the control systems in a furnace unit constructed in accordance with the present invention.

FIG. 2 illustrates in greater detail the operation of the preferred embodiment of flue gas recirculation system 32 and second control system 52 which reduce the NOx production of furnace 12 resulting from the combustion of hydrocarbon fuel.

In operation, combustion air from primary source 14 is combined with combustion air from secondary source 34 within mixing section or chamber 18 of the furnace. The primary source of combustion air is oxygen rich and is most conveniently provided by the ambient air available at site, while the secondary source of combustion air is oxygen-lean as provided by the combustion products returned in the flue gas recirculation system. Thus, the secondary source of combustion air serves to dilute the oxygen concentration provided to the combined combustion air by the primary source.

Fuel is combined with the combined combustion air and a combustion reaction is initiated and sustained in combustion chamber 22 as illustrated by flame 25 in FIG. 1, producing heat and combustion products. The heat is used to perform useful work such as convert water to steam and the combustion products are passed to an exhaust section from which a portion of the exhaust or flue gas is expelled through a stack and the remaining flue gas is drawn into flue gas recirculation system 32 at recirculation line 30. See FIG. 2. In operation of the preferred embodiment of flue gas recirculation system 32, the oxygen concentration of the combined combustion air from the primary and secondary sources is sensed by sensor 40A which generates a signal which is passed to means 42 for controlling the flow ratio of the primary and secondary sources of combustion air, here provided by a programmable logic controller ("PLC") 46A which compares the signal from sensor 40A with a predetermined set point programmed into the PLC and schematically illustrated with reference numeral 48 in this figure. Based on this comparison, an electronic signal is passed to transducer 50 which converts the electronic signal to a pneumatic actuating signal which directly actuates valve 44 within recirculation line 30, thereby controlling the flow rate of the secondary source of combustion air. Of course, application of the present invention is not limited to pneumatically actuated valves. For instance, valve 44 may be hydraulically actuated and transducers 50 serve to convert the signal to a hydraulic signal relayed to the valve, or solenoids may directly throw valve 44 based upon an electronic signal. Alternatively, the speed of a blower or other device provided may be adjusted as the means 42 for controlling the flow ratio of the primary and secondary sources of combustion air. Other variations will be apparent to those skilled in the art familiar with the disclosure.

In the preferred embodiment, the set point 48 for PLC 46A is selected to correspond to an oxygen concentration in the combined combustion air as sensed by sensor 40A in the range of approximately 17–18 percent. As discussed above, adjusting the flow rate of the secondary source of combustion air with a substantially stabilized rate of flow from the primary source is one means for adjusting the flow ratio of the combustion air between the primary and secondary sources as a function of the signal corresponding to the oxygen concentration of the combined combustion air. Thus, in the preferred embodiment, controlling the rate of flue gas recirculation provides fine tuning to minimize NOx production.

The primary source of combustion air is also regulated within the preferred embodiment with secondary control system 52 in which the rate of flow for the primary source of combustion air is controlled as a function of the oxygen concentration sensed in the exhaust gas. Thus a second means for sensing the oxygen concentration in the exhaust gas is provided by such means as sensor 54A which generates a signal corresponding to the oxygen concentration and sends that signal to a second PLC 46B within a means 58 for controlling the flow of the primary source of combustion air. Second PLC 46B compares the signal from sensor 54A against a pre-programmed set point schematically illustrated with reference numeral 72 in FIG. 2. The second PLC 46B then generates an electronic signal which is a function of this comparison and provides this signal to transducer 51 which converts the signal to a pneumatic actuating signal which directly drives valve 76 to control the inflow of ambient air to the mixing chamber. As with control means 42, many variations are within the scope of the invention and means 58 for controlling the flow rate of the primary source of combustion air is not limited to the presently preferred pneumatic valve embodiment.

In the preferred embodiment, the set point 72 of PLC 46B corresponds to an oxygen concentration of approximately 2 percent by volume remaining in the combustion products of the exhaust or flue gas.

Various control and comparing functions have been set forth for programmable logic controllers 46A and 46B. In the preferred embodiment, each of these PLC's are provided by a single multi-function unit. Despite the simplicity and convenience of this approach, it is noted that alternatives will be apparent to those skilled in the art for generating reference signals and comparing sensed signals with the reference signals to generate appropriate control signals.

Various safety features are also provided in the steam generation of the preferred embodiment which employ a third PLC 46C. This too can be conveniently provided by the same PLC unit providing PLC's 46A and 46B. See FIG. 1. PLC 46C senses the positions of limit structure in control means 42 and 58 before initialing start up to ensure that flue gas recirculation is closed and that the primary source of combustion air is available. Start up will not initialize unless these conditions are sensed. Further, a temperature sensor 85 monitors the temperature of the operating furnace to shut the system down if the temperature of the combined combustion air exceeds the rating of the blower.

Figure 3A:
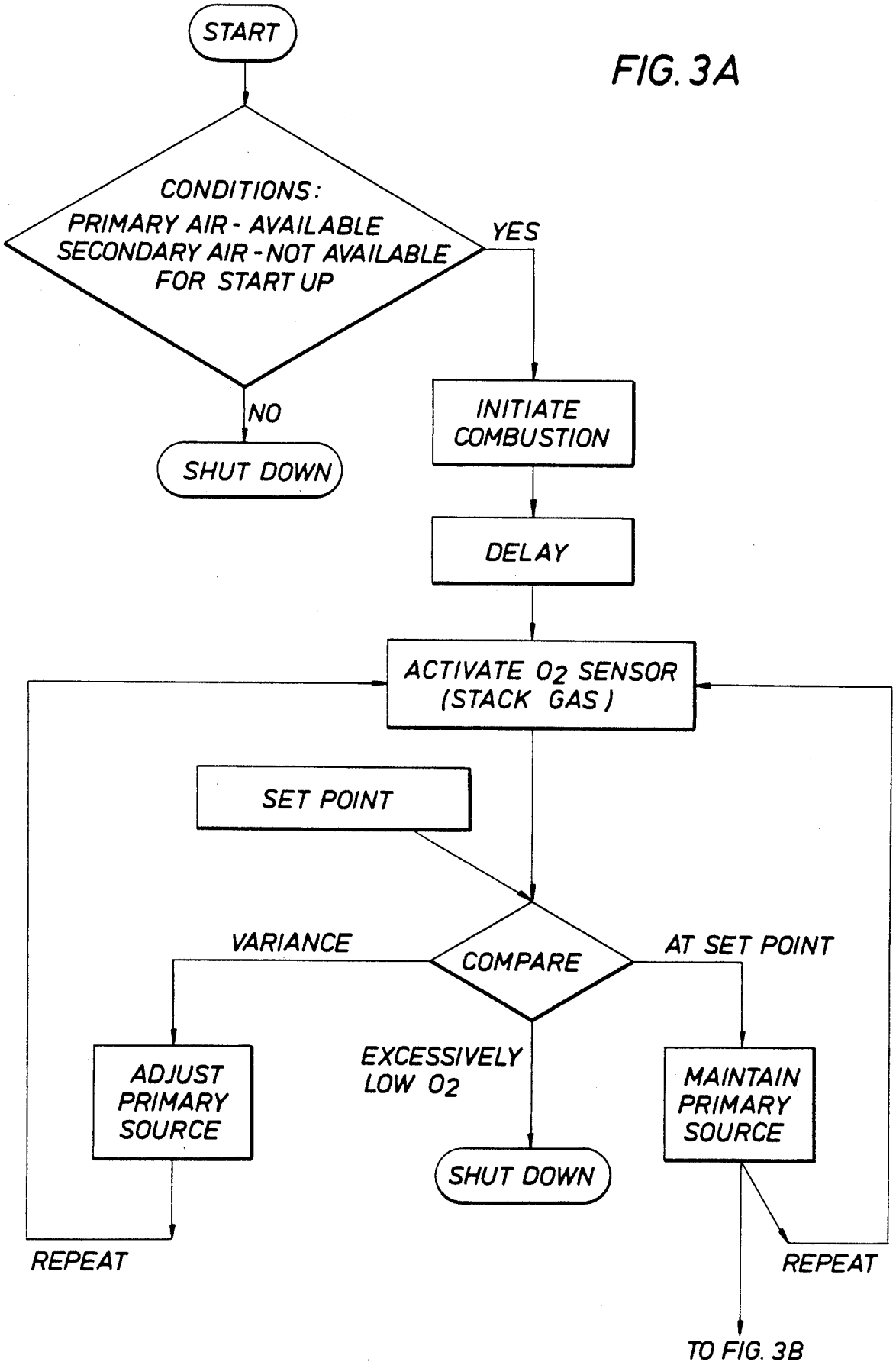
FIGS. 3A and 3B are a flow diagram of the controlled flue gas recirculation in a combustion process in accordance with the present invention.
Figure 3B:
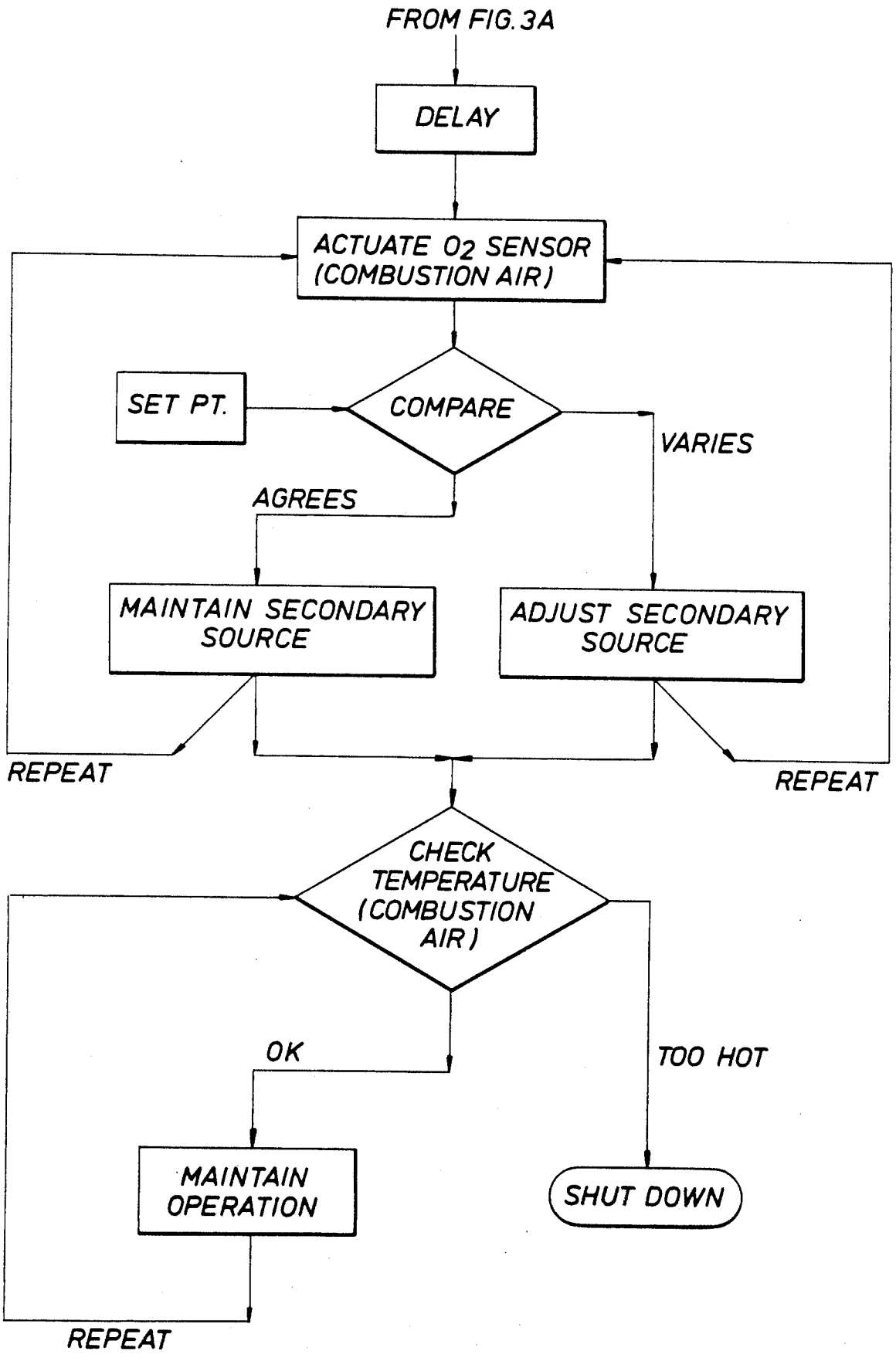

FIGS. 3A and 3B illustrate a flow diagram of the preferred control scheme for the present invention including certain safety features applicable to the steam generator embodiment. This figure also provides the logic for programming the multi-function PLC of the preferred embodiment. Before start-up can be initiated, the limit switches must indicate that the primary source of combustion air is available and that the secondary source of combustion air through flue gas recirculation is shut down and not available for initial combustion. If these conditions are sensed, combustion can be initiated and an automatic delay system in the control circuit allows the generator to reach full fire before the second control system which monitors the exhaust gas is activated. The sensor is activated and then compares the oxygen concentration in the stack gas with a predetermined set point and will determine one of three conditions. If the oxygen concentration in the stack gas is in the acceptable range corresponding to the set point, the primary source of combustion air remains at its current setting and maintains present availability. If there is a variance between the set point and the oxygen concentration sensed, the primary source of combustion air is adjusted. In either instance, this monitoring activity repeats. In the third instance, this comparison may demonstrate an excessively low oxygen concentration indicative of substantial incomplete combustion. Upon sensing this condition, the furnace unit will automatically shut down.

Once the oxygen concentration in the stack gas is substantially stabilized in the range corresponding to the set point, a delay circuit is initiated to insure stabilization. After this automatic delay, the sensor in sensory communication with the combustion air is activated and transmits a signal which is compared with a predetermined set point. If the oxygen concentration sensed is within the range selected for the set point, the flow rate for the secondary source of combustion air is maintained at the current rate. However, if there is a variance, then the flow rate of the secondary source of combustion air is adjusted accordingly. In each instance this monitoring process continues. Further, an additional safety feature provides for checking the temperature in the combustion air and shutting down the furnace unit if it is too hot. Similarly, if this temperature is satisfactory, then operation of the furnace will be maintained and the monitoring will continue to insure operation within an acceptable temperature range.

It is estimated that the present invention will reduce NOx yield to the range of 0.03 to 0.05 pounds per million Btu fired. This is a substantial reduction available by active control to continuously minimize NOx production based on real time conditions rather than the selection of conservative average conditions.

In the presently preferred embodiment of the method and system for flue gas recirculation, as embodied in the illustrated steam generator, the following components have been deployed by the applicants:

TABLE OF COMPONENTS

| ELEMENT | MANUFACTURE AND MODEL |
|---|---|
| Programmable Logic Controller (PLC) 46A, 46B and 46C | Westinghouse PC-1100 |
| Second Sensor 54A | Thermox WDG - III |

-continued

TABLE OF COMPONENTS

| ELEMENT | MANUFACTURE AND MODEL |
|---|---|
| ($O_2$ in Stack Gas) | |
| First Sensor 40A | Thermox FCA |
| ($O_2$ in Blended Combustion Air) | |
| Valve 44 | North American #1147-10 |
| (means for controlling | (valve) |
| secondary source of | North American #1600-5-AP |
| combustion air 42) | (actuator) |
| Valve 76 | North American #1156-16 |
| (means for controlling | (valve) |
| primary source of | North American #1600-5-AP |
| combustion air 58) | (actuator) |
| Transducers 50, 51 | Brandt # PICPT2131 |

The foregoing components are merely illustrative of one embodiment of the present invention and many variations of the present invention are expressly set forth in the preceding discussion. Further, other modifications, changes, and substitutions are intended in the foregoing disclosure, and in some instances some features of the invention will be employed without a corresponding use of other features. Accordingly, it is appropriate that the appended claims be construed broadly and in a manner consistent with the spirit and scope of the invention herein.

What is claimed is:

1. A steam-generating device, comprising:

a furnace unit comprising:

an air intake regulating device which provides a primary source of combustion air which is relatively rich in oxygen;

a mixing chamber in downstream communication with the air intake regulating device;

a combustion chamber in downstream communication with the mixing chamber; and an exhaust section in downstream communication with the combustion chamber;

a flue gas recirculation system comprising:

a recirculation line establishing communication between the exhaust section and the mixing chamber to provide a secondary source of combustion air to the mixing chamber which is relatively lean in oxygen; and a control system comprising:

a sensor for monitoring the oxygen concentration in the mixing chamber and generating a signal which is a function thereof; and a means responsive to the signal for controlling the flow rate of the flue gas through the recirculation line; and a heat exchange system comprising:

a heat exchanger in thermal communication with the furnace unit; and a circulation system extending through the heat exchanger through which water passes and is converted to steam.

2. A steam-generating device in accordance with claim 1 further comprising:

a second control system comprising:

a second sensor for monitoring the oxygen concentration in the flue gas and generating a second signal which is a function thereof; and a controlling unit for controlling the air intake regulating device responsive to the second signal whereby the rate of flow of the primary source of combustion air into the furnace unit is a function of the oxygen concentration in the flue gas.

3. A hydrocarbon fired steam generator comprising:

a primary source of combustion air which contains a substantial oxygen concentration;

a mixing chamber which receives the combustion air provided by the primary source;

a combustion chamber in downstream communication with the mixing chamber;

a fuel inlet in communication with the combustion chamber;

an exhaust section in downstream communication with the combustion chamber;

a recirculation line establishing communication between the exhaust section and the mixing chamber to provide a secondary source of combustion air for communication with the primary source in the mixing chamber;

means for sensing the oxygen concentration in the combined combustion air presented to the mixing chamber and generating a signal as a function thereof;

means for controlling the flow rate of the secondary source of combustion air which is responsive to the signal from the means for sensing the oxygen concentration in the mixing chamber;

a second means for sensing oxygen concentration which is in sensory communication with the exhaust gas and which generates a second control signal which is a function thereof;

means for controlling the flow of the primary source of combustion air which is responsive to the second control signal; and a heat exchanger, comprising:

a water inlet;

a fluid circulation system in thermal communication with the combustion reaction and in communication with the water inlet at one end; and a steam outlet in communication with the other end of fluid circulation system; whereby energy from the combustion reaction is transferred to the water which is converted thereby from a liquid to a vapor phase.

4. A steam generator in accordance with claim 3 wherein the means for controlling the flow rate of the secondary source of combustion air comprises a valve in the recirculation line actuated by the signal from the means for sensing the oxygen concentration in the mixing chamber.

* * * * *